United States Patent [19]

Vogt

[11] Patent Number: 4,956,637

[45] Date of Patent: Sep. 11, 1990

[54] SYSTEM FOR DETECTING IRREGULAR OPERATION OF SWITCH STATE VERIFICATION CIRCUIT

[75] Inventor: William R. Vogt, Rockaway, N.J.

[73] Assignee: Baker Industries, Inc., Parsippany, N.J.

[21] Appl. No.: 187,681

[22] Filed: Apr. 29, 1988

[51] Int. Cl.[5] ..... G08B 21/00

[52] U.S. Cl. ..... 340/644; 340/506

[58] Field of Search ..... 340/644, 635, 506, 507

[56] References Cited

U.S. PATENT DOCUMENTS 4,833,450 5/1989 Buccola et al. ..... 340/506

4,853,685 8/1989 Vogt ..... 340/506 X

*Primary Examiner*—Joseph A. Orsino

*Assistant Examiner*—Jeffery A. Hofsass

*Attorney, Agent, or Firm*—James J. Jennings

[57] ABSTRACT

A system for debouncing a switch circuit includes a sample circuit for providing an initial determination of the switch status, and a debounce circuit connected to operate on the output of the sample or sensing circuit to verify the actual switch status by providing a confirmation signal. The system of the invention accumulates a count related either to the rate at which the sample circuit operates, or the actual changes in state indicated by latches coupled to the sample circuit. If the count accumulates to a predetermined number before being cleared by a confirmation signal verifying the switch status, then the irregular operation is signalled. This identifies a continuous, rapid alternation between different switch states without a confirmation of an actual state change, which would otherwise be undetected by system operation.

8 Claims, 3 Drawing Sheets

TYPICAL TRANSPONDER

SYSTEM FOR DETECTING IRREGULAR OPERATION OF SWITCH STATE VERIFICATION CIRCUIT

The present invention is especially useful in fire and/or burglary alarm systems which include a switch monitoring system for continually examining a status signal indicating the switch state, and providing a confirmation signal upon verifying that the switch is actually in the state denoted by the status signal. In particular the present invention provides an indication to identify when the present state of the switch cannot be confirmed. This indication is termed a "jam" condition for purposes of this explanation.

BACKGROUND OF THE INVENTION

Various types of circuits have been employed to determine the status or condition of the switch, and provide an indication of the switch condition. By way of example, U. S. Pat. No. 4,658,249, entitled "Data Communication System With Key Data Bit Denoting Significance of Other Data Bits", which issued Apr. 14, 1987 to William R. Vogt, and is assigned to the assignee of this application, includes a generalized showing of a switch state determination circuit. An improvement to that determination circuit of the '249 patent was subsequently described and claimed in an application entitled "Switch Monitoring Arrangement With Remote Adjustment Capability Having Debounce Circuitry For Accurate State Determination", filed Apr. 29, 1988, Ser. No. 188,323, which issued Aug. 1, 1989 as U.S. Pat. No. 4,853,685 in the name of William R. Vogt, and is assigned to the assignee of the present application. In addition to the remote adjustment feature described in the '685 patent, a two-step arrangement is provided in which each time the switch changes state, a status signal connoting the actual switch state is produced. In addition the '685 patent teaches the production of a confirmation signal upon verifying the presence of the status signal for some preset time. This operation, coupled with the remote adjustment feature, produced a significant step forward in this art.

It has since been observed that the switch may oscillate rapidly, producing changing status signals, without ever remaining in the given state for the preset time period so that a confirmation signal can be provided, to verify that the switch is indeed in an appropriate state and has been there for the preset time. Such operation would appear abnormal to the usual system, because neither a trouble nor an alarm, nor any other unusual signal, is generated by the rapid variation of the switch and the status signals. Nevertheless such operation is undesirable, as an intermittent connection or some other aberration could provide this rapid oscillation between states without being detected by alarm systems presently in use.

It is therefore a principal consideration of the present invention to provide a system for detecting irregular operation of a switch state monitoring system, particularly monitoring arrangements in which switch status is first indicated and subsequently confirmed by another circuit.

SUMMARY OF THE INVENTION

The present invention is useful with an arrangement which monitors the condition of a switch having at least two possible states. Such an arrangement provides a status signal connoting the switch state and also a confirmation signal upon verifying the status signal.

The system of this invention which identifies irregular system operation includes a counter, which has a first input for receiving data, such as the status signal, each time the switch changes state. The counter also includes a second input, for receiving a counter-clearing signal. The counter includes an output connection for providing an output signal denoting irregular system operation.

Means is coupled to the counter second input connection for providing the counter-clearing signal upon verifying that the switch is in one of its possible states. If this verification is not received before the counter accumulates a preset count of changes in the status signal, then the output signal denoting irregular system operation is generated.

THE DRAWINGS

In the several figures of the drawings, like reference numerals identify like components, and in those drawings.

GENERAL SYSTEM DESCRIPTION

Figure 1:
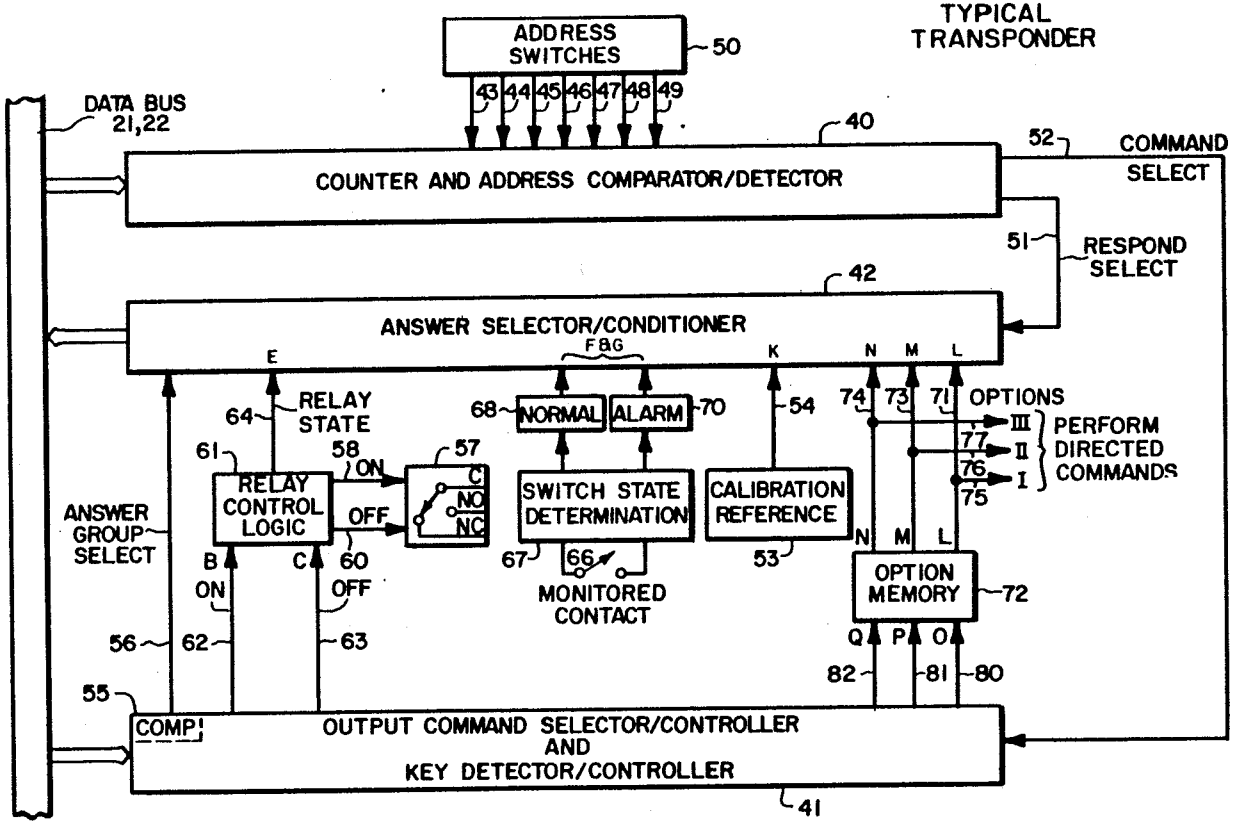
FIG. 1 is a block diagram, similar to FIG. 7 in the earlier '249 patent, useful to provide a background for the present invention.

FIG. 1 depicts a typical transponder, or transmitter/receiver, useful in the communication system of the type described in the '249 patent. That system is particularly suited for bidirectional communication over a data bus labeled 21,22 in the drawing. The transponder recognizes, in unit 40, when it has been addressed and, in conjunction with the controller 41 effects certain operations, including the answer back over unit 42. The switch state condition is determined by circuit 67, and signal back is controlled over the inputs labeled F and G within unit 42. All the reference numerals in FIG. 1 correspond exactly to reference numerals in FIG. 7 of the '249 patent, to facilitate use of that patent as background for the present invention.

Figure 2:
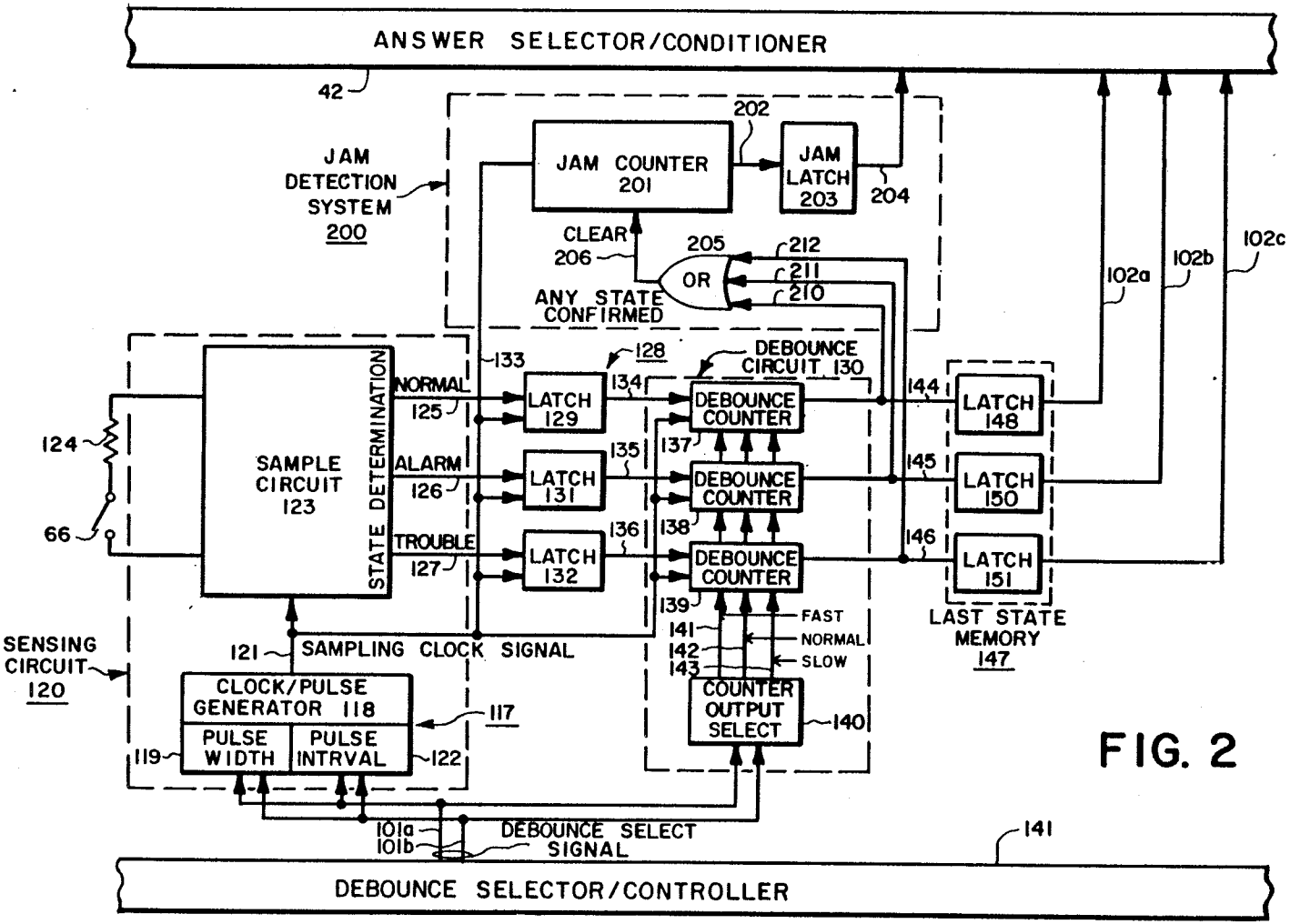
FIG. 2 is a block diagram describing the invention in connection with the switch monitoring arrangement of the cited '685 patent.

FIG. 2 depicts the jam detection system 200, and its components, in conjunction with the sensing and debounce circuits described and claimed in the '685 patent The reference numerals from 100 through 166 indicate corresponding components described and similarly referenced in that patent. Hence reference can readily be made to the '685 patent for an extensive description of sensing circuit 120 and debounce circuit 130, as well as the other components depicted in FIG. 2.

Briefly, the system in the '685 patent and the lower portion of FIG. 2 of this application makes a preliminary estimate of the state of switch contact set 66 in sample circuit 123, providing a state determination or a status output signal on one of lines 125, 126, and 127. This initial status signal is reflected through the latch circuit 128, and a signal denoting one of the three states appears on one of the conductors 134, 135 or 136. The respective debounce counters 137, 138 and 139 are set for a preset time period by the fast, normal and slow signals received over one of the lines 141, 142 and 143 through the counter output select circuit 140. If the status signal is present for the time set in the appropriate counter, then a confirmation signal is issued over one of the conductors 144, 145 and 146 to be latched in the last state memory circuit 147, before presentation to the answer selector/conditioner circuit 42. Thus the status signal on one of conductors 125–127 is in the nature of an initial estimate, with a confirmation appearing at the output of the debounce counters 137–139 to indicate that there is a verified condition of the switch state. A more detailed explanation will be found in the '685 patent, which describes how the debounce select signal on conductors 101*a* and 101*b* controls the sampling clock signal on line 121 as well as the output of select circuit 140.

DETAILED DESCRIPTION OF THE INVENTION

From the foregoing it is evident that a preliminary determination of the status of switch 66 is made by providing a status signal on one, and only one, of the normal conductor 125, alarm conductor 126, and trouble conductor 127. The final confirmation is made in the debounce counters 137–139, so that once a state has been verified, a positive indication of that verification appears on conductors 144, or 145, or 146.

In accordance with the present invention, a jam detection system 200 is provided. The system includes a jam counter 201, and a jam latch circuit 203, connected over an input connection to receive over conductor 202 the output signals (if any) from jam counter 201. The output side of jam latch 203 is coupled over conductor 204 to answer selector/conditioner 42.

An OR circuit 205 is provided as shown, with an output conductor 206 coupled to a clear input of jam counter 201. When a signal appears on conductor 206, it indicates that one of the states (normal, alarm or trouble) has been confirmed by receiving an output signal from one of the debounce counters 137–139. To this end, the first input of OR circuit 205 is coupled over conductor 210 to the normal output of debounce counter 137; the second input is coupled over conductor 211 to the output side of debounce counter 138, the alarm debounce circuit; and a third input of OR circuit 205 is coupled over conductor 212 to the output side of debounce counter 139, in the trouble confirmation arrangement. Thus each time any state is confirmed by a signal appearing on any of conductors 210, 211 or 212, the confirmation signal passes directly through the OR gate and over conductor 206 to the second, or clear, input of jam counter 201.

Switch 66 is shown as a mechanical switch, but those skilled in the art will appreciate that this switch could be another type of switch such as a semiconductor. At least two possible states of the switch are provided at the output side of sample circuit 123, and the status signal is presented on one of the conductors 125–127. Each time one of the latches 129–132 receives a clock signal over line 133, an identical clock signal appears at the first input of jam counter or first means 201. The jam counter will thus count up to any predetermined number before issuing an output signal over line 202 to jam latch 203. However as soon as any state is confirmed in the debounce circuit 130, a clear signal appears on line 206 and reduces the count to zero in jam counter 201. The usual condition of the system is to be in one of the possible states determined by circuit 123 and the debounce circuit 130, and thus in the normal state the confirmation signal passing through the OR circuit 205 will keep the jam counter cleared.

However, in accordance with the present invention, if there is switching back and forth between any of the normal, alarm, and trouble or other designated states, without being in any state sufficiently long to provide an output confirmation from one of the debounce counters 137–139, the requisite total of sampling clock pulses on line 133 will be accumulated in jam counter 201 and provide an output signal over line 202 to indicate the jam or irregular condition. This feature, positive identification that a circuit cannot identify a state within a predefined period, is not found in other alarm systems presently available.

Figure 3:
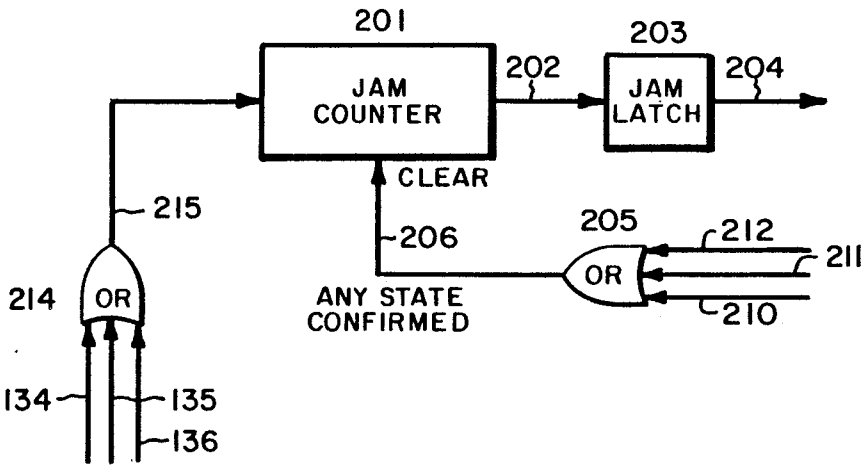
FIG. 3 is a block diagram depicting another embodiment of the present invention.

It is possible to implement the present invention in another manner. FIG. 3 depicts the jam counter, jam latch and OR circuit 205 in the same manner as shown in FIG. 2. However in FIG. 3 the first or data input of jam counter 201 is coupled over conductor 215 to another OR circuit 214, the three inputs of which are respectively coupled to conductors 134, 135 and 136. This means as soon as latch 129 is set indicating a normal signal has been found by sample circuit 123, a signal passes through OR circuit 214 and over conductor 215 to the data input of jam counter 201. Likewise the output sides of latches 131 and 132 are coupled over conductors 135 and 136 to the other two inputs of OR circuit 214. In this way the data signal provided as the first input to jam counter 201 identifies the number of state changes before a clearing signal appears at the second input connection of jam counter 201, provided by confirmation of any state in the debounce counter arrangement. Both of the systems shown in FIGS. 2 and 3 are useful in implementing the concept of the basic invention.

In the appended claims the term "connected" means a d-c connection between two components with virtually zero d-c resistance between those components. The term "coupled" indicates there is a functional relationship between two components, with the possible interposition of air or other elements between the two components described as "coupled" or "intercoupled".

While only particular embodiments of the invention have been described and claimed herein, it is apparent that various modifications and alterations of the invention may be made. It is therefore the intention in the appended claims to cover all such modifications and alterations as may fall within the true spirit and scope of the invention.

What is claimed is:

1. For use with an arrangement for monitoring and indicating the condition of a switch having at least two possible states, sampling the switch state to provide a status signal connoting the switch state and thereafter examining the status signal to provide a confirmation signal upon verifying the status signal, a system for identifying irregular system operation, including:

first means to accumulate a count of data signals related to switch state sampling, to receive the confirmation signal, and to provide an output signal denoting irregular system operation when the accumulated count reaches a predetermined value; and second means, coupled to the first means to provide said confirmation signal and clear the count accumulated in the first means upon verification that the switch is in one of its possible states.

2. For use with an arrangement for monitoring and indicating the condition of a switch having at least two possible states, sampling the switch state to provide a status signal connoting the switch state and thereafter examining the status signal to provide a confirmation signal upon verifying the status signal, a system for identifying irregular system operation, including:

a counter, having a first input for receiving data signals related to the switch state sampling and accumulating a count of the received data signals, a second input for receiving a counter-clearing signal, and an output for providing an output signal denoting irregular system operation when the accumulated count reaches a predetermined value; and means, coupled to the counter second input, for providing said counter-clearing signal to clear the accumulated count upon verifying that the switch is in one of its possible states.

3. A system for identifying irregular system operation as claimed in claim 2, in which the switch monitoring arrangement includes means for providing timing pulses, and the timing pulses are applied as the data signals to the first input of the counter.

4. A system for identifying irregular system operation as claimed in claim 2, in which the switch monitoring arrangement includes means for providing a plurality of switch state-indicating signals, and the state-indicating signals are applied as the data signals to the first input of the counter.

5. In an arrangement for monitoring the condition of a switch having a sample circuit for providing a status signal indicating the switch condition, and a plurality of debounce counters respectively coupled to the sample circuit to verify the switch state by providing a confirmation signal, the improvement which comprises a jam detection system having a jam counter with a first input for receiving data signals related to the switch state, a second input for receiving a clear signal when one of the debounce counters verifies the switch state by providing a confirmation signal, and an output connection for providing a jam indication when the jam counter accumulates to a predetermined count without receiving a clear signal indicating verification of the switch state.

6. A switch monitoring system as claimed in claim 5, and in which the data signals supplied to the jam counter indicate the sampling periods in which the sample circuit operates to determine the switch status.

7. A switch monitoring system as claimed in claim 5, and in which the data signals provided to the jam counter indicate a change in state of the status signal indicating the switch condition.

8. The method of supervising a monitoring and indicating system for a switch which has at least two possible states, comprising the steps of:

sampling the switch state to provide a status signal indicating the switch state;

confirming the switch state by examining the status signal to provide a confirmation signal;

accumulating a count based on data signals related to the status signal;

clearing the count upon each provision of the confirmation signal; and providing a malfunction signal when the count accumulates to a predetermined value before the confirmation signal is provided to clear the accumulated count.

* * * * *